US011130656B2

(12) United States Patent
Dold et al.

(10) Patent No.: US 11,130,656 B2
(45) Date of Patent: Sep. 28, 2021

(54) ELEVATOR INSTALLATION HAVING A SUPPORTING MEANS, AROUND WHICH AN ELECTRICALLY CONDUCTIVE HOUSING PARTIALLY EXTENDS, IN PARTICULAR AT A DEFLECTING ROLLER ARRANGEMENT

(71) Applicant: Inventio AG, Hergiswil (CH)

(72) Inventors: Florian Dold, Bremgarten (CH); Volker Zapf, Kriens-Obernau (CH)

(73) Assignee: INVENTIO AG, Hergiswil (CH)

( * ) Notice: Subject to any disclaimer, the term of this patent is extended or adjusted under 35 U.S.C. 154(b) by 443 days.

(21) Appl. No.: 16/086,625

(22) PCT Filed: Mar. 22, 2017

(86) PCT No.: PCT/EP2017/056842
§ 371 (c)(1),
(2) Date: Sep. 20, 2018

(87) PCT Pub. No.: WO2017/162749
PCT Pub. Date: Sep. 28, 2017

(65) Prior Publication Data

US 2020/0307958 A1 Oct. 1, 2020

(30) Foreign Application Priority Data

Mar. 23, 2016 (EP) ..... 16161847

(51) Int. Cl.
*B66B 15/02* (2006.01)
*B66B 7/12* (2006.01)

(52) U.S. Cl.
CPC ..... *B66B 15/02* (2013.01); *B66B 7/1223* (2013.01)

(58) Field of Classification Search
CPC ..... B66B 15/02; B66B 15/04; B66B 7/1223
See application file for complete search history.

(56) References Cited

U.S. PATENT DOCUMENTS 7,123,030 B2 10/2006 Robar et al.
2011/0148442 A1 6/2011 Berner et al.
(Continued)

FOREIGN PATENT DOCUMENTS

CN 102317193 A 1/2012
CN 102448864 A 5/2012
(Continued)

OTHER PUBLICATIONS

Machine Translation WO 2014001372.*
Machine Translation WO 2014191374.*

*Primary Examiner* — Diem M Tran
(74) *Attorney, Agent, or Firm* — William J. Clemens; Shumaker, Loop & Kendrick, LLP

(57) ABSTRACT

An elevator installation wherein damage to a support for an elevator car and a counterweight, in particular damage to a sheath of the support, advantageously can be detected. At the elevator installation, a housing at least partially extending around the support, for example at a deflecting roller arrangement. A surface of the housing facing the support is electrically conductive and is electrically grounded. If the support or a wire coming out of the damaged support comes in contact with the housing, an electrical ground fault results. The ground fault can be detected by a security monitoring unit by monitoring a current flowing through the wires of the support, and the damage to the support can thus be inferred.

19 Claims, 4 Drawing Sheets

(56) References Cited

U.S. PATENT DOCUMENTS

| | | | | |
|---|---|---|---|---|
| 2011/0220438 | A1* | 9/2011 | Annen | H01R 12/592 187/251 |
| 2011/0284331 | A1 | 11/2011 | Stucky et al. | |
| 2013/0207668 | A1 | 8/2013 | Fargo et al. | |

FOREIGN PATENT DOCUMENTS

| | | | |
|---|---|---|---|
| DE | 202015104475 | U1 | 10/2002 |
| EP | 1730066 | B1 | 10/2010 |
| FI | 109897 | B | 9/2002 |
| KR | 100406871 | B1 | 11/2003 |
| WO | 02074677 | A2 | 9/2002 |
| WO | 2014001372 | A1 | 1/2014 |
| WO | 2014191374 | A1 | 12/2014 |

* cited by examiner

ELEVATOR INSTALLATION HAVING A SUPPORTING MEANS, AROUND WHICH AN ELECTRICALLY CONDUCTIVE HOUSING PARTIALLY EXTENDS, IN PARTICULAR AT A DEFLECTING ROLLER ARRANGEMENT

FIELD

The present invention relates to an elevator installation and to a deflecting roller arrangement for an elevator installation of this type.

BACKGROUND

In elevator installations, an elevator car is used to largely vertically carry people or objects within a building or structure. Here, the elevator car is supported and moved by a supporting means or support. The supporting means usually comprises one or more cables or belts. In order for it to be possible to move the elevator car, the supporting means is generally moved by means of a drive motor. In this case, the cables or belts of the supporting means are usually moved by a driving pulley rotatingly driven by the drive motor. Usually, a counterweight is also fastened to the supporting means in addition to the elevator car, and moves in the opposite direction to the elevator car when the supporting means is moved by means of the drive motor. In this case, the elevator car and the counterweight form movable elevator components of the elevator installation, which are each supported by the supporting means.

The cables or belts of the supporting means are typically fastened to the building, for example to a ceiling of an elevator shaft, by their ends and support the elevator car by means of one or more deflecting roller arrangements attached to said elevator car. Alternatively, the cables or belts may also be fastened to the elevator car by one end and supported on the ceiling of the elevator shaft by means of deflecting roller arrangements. Other types of cable or belt guidance are also possible, at least one deflecting roller arrangement generally always being provided in order to deflect a movement direction of the cables or belts, usually at least by approximately 90°, often even by approximately 180°.

Since the supporting means in particular has to support the elevator car, it always has to be ensured that the supporting means remains intact and functional during operation of the elevator installation.

Modern supporting means usually consist of a plurality of metal wires or strands (referred to in the following just as "metal wires"), by means of which the load on the elevator car can be supported. Here, the metal wires are usually surrounded by a plastics sheath, for example in order to protect them against corrosion, against mechanical damage and/or to make it possible to increase the friction against the driving pulley. Plastics-sheathed supporting means of this type make it very difficult to see from the outside whether metal wires received therein are intact.

Therefore, a method for monitoring a state of a supporting means in an elevator system has been developed in which electrical currents are conducted through the electrically conductive metal wires or strands. A state of the supporting means can be inferred on the basis of the behavior of these electrical currents, since, for example, damaged metal wires can impair or even prevent the flow of current. Methods of this type or methods that operate in a similar way and devices that are suitably designed for this purpose are described inter alia in EP 1 730 066 B1, U.S. Pat. No. 7,123,030 B2, US 2011/0284331 A1, US 2013/0207668 A1, and others.

SUMMARY

There may be a need for an elevator installation in which precautions are taken in order for it to be possible to monitor the intactness and the state of the supporting means in a manner that is reliable and technically simple to implement. Furthermore, there may be a need for a deflecting roller arrangement for an elevator installation of this type.

Such a need may be addressed by the subject matter of the present invention. Advantageous embodiments are specified in the following description.

According to a first aspect of the present invention, an elevator installation is described which comprises a supporting means, a movable elevator component, such as an elevator car or a counterweight, supported by the supporting means, and a housing surrounding the supporting means at least in part. In this case, the housing is arranged and designed such that the supporting means can move relative to the housing. A surface of the housing facing the supporting means is intended to be electrically conductive and electrically grounded.

According to a second aspect of the invention, a deflecting roller arrangement for an elevator installation is described which comprises a deflecting roller and a housing. The deflecting roller is intended to be mounted so as to rotate relative to the housing. The housing surrounds the deflecting roller at least in regions and so as to be adjacent to, but preferably at least with slight spacing from, a surface of the deflecting roller. A surface of the housing facing the deflecting roller is electrically conductive and is connected to an electrical connector in order to connect to an electrical grounding. A deflecting roller arrangement of this type can be used to design a specific embodiment of an elevator installation configured according to the first aspect of the invention.

Ideas for embodiments of the present invention may be considered, among others and without limiting the invention, to be dependent upon the findings and considerations described below.

In methods which are intended to determine a state of a supporting means of an elevator installation by monitoring an electrical current conducted through the supporting means, it has been found to be very difficult to establish when, for example, a plastics sheath around the electrically conductive metal wires has sustained damage. Damage of this type may for example be breakages in the plastics sheath, local abrasion to the plastics sheath, or even ends of broken metal wires locally penetrating through the plastics sheath from the inside.

In order for it to be possible in particular to more reliably detect said possible damage to a supporting means, it is proposed for a housing to also be provided in the elevator installation, which surrounds the supporting means at least in part but is suitably designed and arranged to allow the supporting means to still move through the housing in a largely unimpeded manner. This means that the supporting means is intended to be able to move relative to the housing. For example, the housing may be hollow and open at opposite ends such that the supporting means can be moved through the open ends and through the hollow housing. The housing may potentially also surround the supporting means merely in part, i.e. for example may have a U-shaped cross section through the inside of which the supporting means can be moved.

A surface of the housing facing the supporting means is intended to be electrically conductive and connected to an electrical grounding. If, for example, the plastics sheath of the supporting means locally surrounded by the housing is damaged, there may be contact between metal wires of the supporting means that are no longer protected by the plastics sheath and the electrically conductive surface of the housing.

For example, metal wires or strands emerging from the supporting means through the damaged sheath, or, in the case of breakages, the free ends thereof, may contact the electrically conductive surface of the housing. In this case, contact can be made both mechanically and electrically. Because this surface of the housing is electrically grounded, electrical grounding of the wire of the supporting means that is in contact with said surface may thus occur. An electrical ground fault of this type can be easily and reliably prevented by a security monitoring unit, which monitors the electrical properties of the supporting means on the basis of an electrical current conducted through the metal wires thereof, since the electrical properties of the supporting means change considerably due to a ground fault of this type.

In the following, a number of embodiments of an elevator installation according to the invention are first described, and then some embodiments of a deflecting roller arrangement according to the invention for an elevator installation are described.

According to one embodiment, the elevator installation additionally comprises a deflecting roller. In this case, the supporting means supports the movable elevator component, i.e. in particular the elevator car, by passing around this deflecting roller at least in part. The housing surrounds the deflecting roller at least in part in a region in which the supporting means passes around the deflecting roller, the housing surrounding the deflecting roller at least with slight spacing from the supporting means.

In other words, a deflecting roller arrangement comprising at least one deflecting roller may be provided in the elevator installation, which roller, by means of the housing surrounding the deflecting roller at least in part, can be used not only to change a movement direction of the supporting means, but also to make it possible to detect any damage in the supporting means, in particular in a sheath of the supporting means.

Here, the deflecting roller can for example be fastened to the movable elevator component and can be moved together with said component within the elevator shaft. Alternatively, the deflecting roller may also be mounted in the elevator shaft so as to be fixed in position.

Lastly, the deflecting roller is used to divert, i.e. change the movement direction of, the supporting means, which passes around the lateral surface thereof at least in part, such that the diverted supporting means can support and where necessary move the elevator car and the counterweight within the elevator shaft counter to its gravitational force.

Because the housing surrounds the deflecting roller at least in part in a region in which the supporting means passes around the deflecting roller, the housing can easily be fastened to a bearing of the deflecting roller, for example, such that although the housing is supported adjacently to the deflecting roller, it cannot rotate, unlike the mounted deflecting roller, but instead can be fixed in position and orientation, for example can be mounted on an elevator car. The housing can thus be constructed together with said deflecting roller so as to form an integral deflecting roller arrangement, for example.

It may however be equally important for the housing, and in particular the electrically conductive surface thereof, to extend close to a region in which the supporting means passes around the deflecting roller and thus is itself curved. In particular in these curved regions of the supporting means, it is more likely that, in the event of local damage to a sheath of the supporting means, parts of the metal wires received therein will protrude out of the sheath and come into contact with the electrically conductive surface of the housing. Therefore, the likelihood of damage of this type to the supporting means being able to be detected on the basis of the electrical ground fault that then occurs can increase sharply.

In this case, the housing is preferably designed such that the deflecting roller is at a spacing from the supporting means in order to prevent friction with the supporting means and associated wear as far as possible; however, the electrically conductive surface of the housing is also intended to be as close as possible to the supporting means in order to increase the chances of being able to detect damage to the supporting means.

For example, the minimum spacing between the surface of the supporting means closest to the housing and the electrically conductive surface of the housing opposite this surface is intended to be less than the thickness of the supporting means, preferably less than 50% or even less than 20% of the thickness of the supporting means. In particular, such spacing may preferably be less than 3 cm, preferably less than 1 cm or even less than 5 mm, in particular in a range of from 1 mm to 3 mm.

According to an embodiment of the elevator installation according to the invention, the surface of the housing facing the supporting means is opposite a rear surface of the supporting means. Here, the rear surface of the supporting means is opposite a front surface of the supporting means by means of which the supporting means contacts a deflecting roller and/or a driving pulley.

In other words, a supporting means used in an elevator installation usually has a front surface, sometimes also referred to as a contact surface, by means of which it is moved along a lateral surface of a deflecting roller or driving pulley, for example. In some cases, the front surface of the supporting means is structured, i.e. it has for example grooves extending in the longitudinal direction that may have a V-shaped, U-shaped or rectangular cross section, for example. A supporting means, designed as a belt, for example, comprises a rear surface opposite this front surface, which rear surface usually does not come into mechanical contact with a deflecting roller and/or driving pulley. The rear surface of the supporting means is generally not structured, but is smooth. A sheath for metal wires within the supporting means is often thicker on the front surface than on the rear surface. The risk of damage to a sheath of this type that exposes these metal wires, for example, may be greater on the rear surface than on the front surface. In addition, due to repeated bending of the supporting means, during which the deflecting roller is guided along the lateral surface of the deflecting roller so as to pass therearound, broken metal wires inside the sheath may be pushed outwards, i.e. toward the rear surface, opposite to the bending. In the event of damage to the sheath, these metal wires may be pushed out of the rear surface and may protrude beyond the rear surface of the supporting means, such that they can then come into mechanical contact with the electrically conductive surface of the housing arranged so as to be adjacent thereto. The likelihood of being able to detect damage to the supporting means due to an electrical ground fault that then occurs therefore increases if the housing is arranged suitably close to the supporting means passing around the deflecting roller and in particular close to the rear surface thereof.

According to an embodiment, the housing comprises a housing body consisting of plastics material and an electrically conductive layer arranged on the surface facing the supporting means.

In principle, the housing can of course also consist of electrically conductive material, such as a metal, and thus the entire structure thereof can be electrically conductive. However, a housing that is mostly made of plastics material is simpler and/or more cost-effective to produce. In particular, the housing generally does not need to withstand any high mechanical loads, and therefore designing the housing to have a housing body consisting of plastics material generally satisfies the mechanical requirements placed on the housing. In order to design the surface of the housing facing the supporting means to be electrically conductive despite the plastics housing body being designed to be electrically non-conductive, the housing body can be provided with an electrically conductive layer on this surface. The electrically conductive layer may for example be a metal layer. An electrically conductive layer of this type may for example be vapor-deposited or printed onto the desired surface, or applied in another way.

According to a specific embodiment, the electrically conductive layer may be formed by an electrically conductive foil. The electrically conductive foil may for example be a metal foil or a foil coated with metal, which can be appropriately glued, bonded or otherwise fastened to the surface of the housing or housing body facing the supporting means. The foil may preferably be self-adhesive. An electrically conductive foil of this type may be both simple to produce and simple to attach to the housing or housing body.

Alternatively or additionally, in another specific embodiment, the housing comprises a housing body consisting of plastics material and an electrically conductive conductor path arranged on the surface facing the supporting means. In other words, an extensive electrically conductive layer does not necessarily need to be provided on the housing, but instead it may be sufficient to just provide a relatively narrow, elongate, electrically conductive conductor path on the surface of the housing facing the supporting means. A conductor path of this type may for example be formed locally on a surface of the main body, similarly to on a circuit board, for example by printing on and hardening an electrically conductive paste, or in a similar manner.

According to an embodiment, the electrically conductive surface of the housing is grounded by means of a cable attached to the housing. Here, the cable is in electrical contact with the electrically conductive layer or conductor path, for example, on the surface of the housing facing the supporting means. The cable may be connected to an electrical ground potential at the other end thereof.

According to an embodiment, the supporting means comprises one or more sheathed, electrically conductive wires, and the elevator installation comprises a security monitoring unit that applies an electrical voltage to the metal wires of the supporting means and is designed to detect an electrical ground fault of these metal wires. In other words, the security monitoring unit can for example be used to detect when an electrical current caused by the applied electrical voltage and flowing through the wires of the supporting means changes due to an electrical ground fault. Local damage to the supporting means, in particular damage to the sheath of the supporting means, which leads to electrical contact between the metal wires and the electrically conductive surface of the housing surrounding the supporting means, can then be inferred from such a change to the applied voltage or to a current flowing through the supporting means induced thereby.

According to an embodiment of the elevator installation, the housing is preferably fastened to the movable elevator component, i.e. in particular to the elevator car or the counterweight.

For example, the housing may be part of a deflecting roller arrangement which is fastened to the elevator car and by means of which the elevator car is supported by the supporting means. Deflecting roller arrangements conventionally often already include precautions in order to prevent a supporting means that is temporarily not under tension from coming off the deflecting roller in the axial direction. For this purpose, retaining devices, sometimes also referred to as "retainers", may be provided so as to be adjacent to a lateral surface of a deflecting roller on which the supporting means is normally guided. Retaining devices of this type are designed to prevent the supporting means from being able to move away from the lateral surface of the deflecting roller, in particular in a slack cable situation in which e.g. a generally profiled belt of the supporting means is no longer guided by its profile on the deflecting roller.

For the elevator installation according to the invention that is proposed in the present case, a retaining device of this type can be suitably developed to form the housing defined herein by precautions being taken on a surface of the housing facing the supporting means in order to design this surface to be electrically conductive and to then electrically ground this electrically conductive surface.

In other words, embodiments of the concept according to the invention can be implemented as part of a specially designed deflecting roller arrangement in a particularly simple manner by conventionally already provided retaining devices on deflecting rollers being developed to form suitable housings comprising an electrically conductive surface facing the supporting means.

According to an embodiment of a deflecting roller arrangement of this type, the surface of the housing facing the deflecting roller is opposite the lateral surface of the deflecting roller. Because, in practical use of the deflecting roller arrangement within an elevator installation, the supporting means of the elevator installation contacts this lateral surface of the deflecting roller and passes therearound at least in part, the surface of the housing opposite this lateral surface of the deflecting roller is also opposite the supporting means, in particular the rear surface of the supporting means. This can result in the above-described advantages in terms of it being simple to detect a ground fault due to damage to the sheath of the supporting means.

According to an embodiment of the deflecting roller arrangement, the housing may comprise a housing body consisting of plastics material and an electrically conductive layer arranged on the surface facing the deflecting roller. Corresponding advantages of this type of design of the housing have already been described above with reference to an embodiment of the elevator installation according to the invention. In this case too, the electrically conductive layer may be formed by an electrically conductive foil. Alternatively or additionally, the housing may comprise a housing body consisting of plastics material and an electrically conductive conductor path arranged on the surface facing the deflecting roller. The deflecting roller arrangement may additionally comprise a cable that is connected to the electrical connector of the housing and is used to provide an electrical connection to a ground potential.

According to another embodiment, the deflecting roller arrangement may also comprise a breakage detection apparatus comprising at least one electrically conductive conductor path extending along the housing. A breakage detection apparatus of this type may be used to detect a breakage in the housing, as may occur due to mechanical overloading. For this purpose, monitoring can be carried out as to whether the conductor path extending on the housing has been damaged or even interrupted due to the breakage. The breakage detection apparatus can for example detect unintended axial movement of the supporting means during operation of the elevator installation, in particular what is known as belt slip in the axial direction.

It should be noted that some of the possible features and advantages of the invention are described here with reference to different embodiments, with some relating to the elevator installation and some to the deflecting roller arrangement. A person skilled in the art recognizes that features may be combined, adapted, or exchanged as appropriate in order to arrive at other embodiments of the present invention.

Embodiments of the invention are described below with reference to the accompanying drawings, wherein neither the drawings nor the description are to be interpreted as limiting the present invention.

The drawings are only schematic and are not true to scale. Like reference signs refer in different drawings to like or functionally like features.

DETAILED DESCRIPTION

Figure 1:
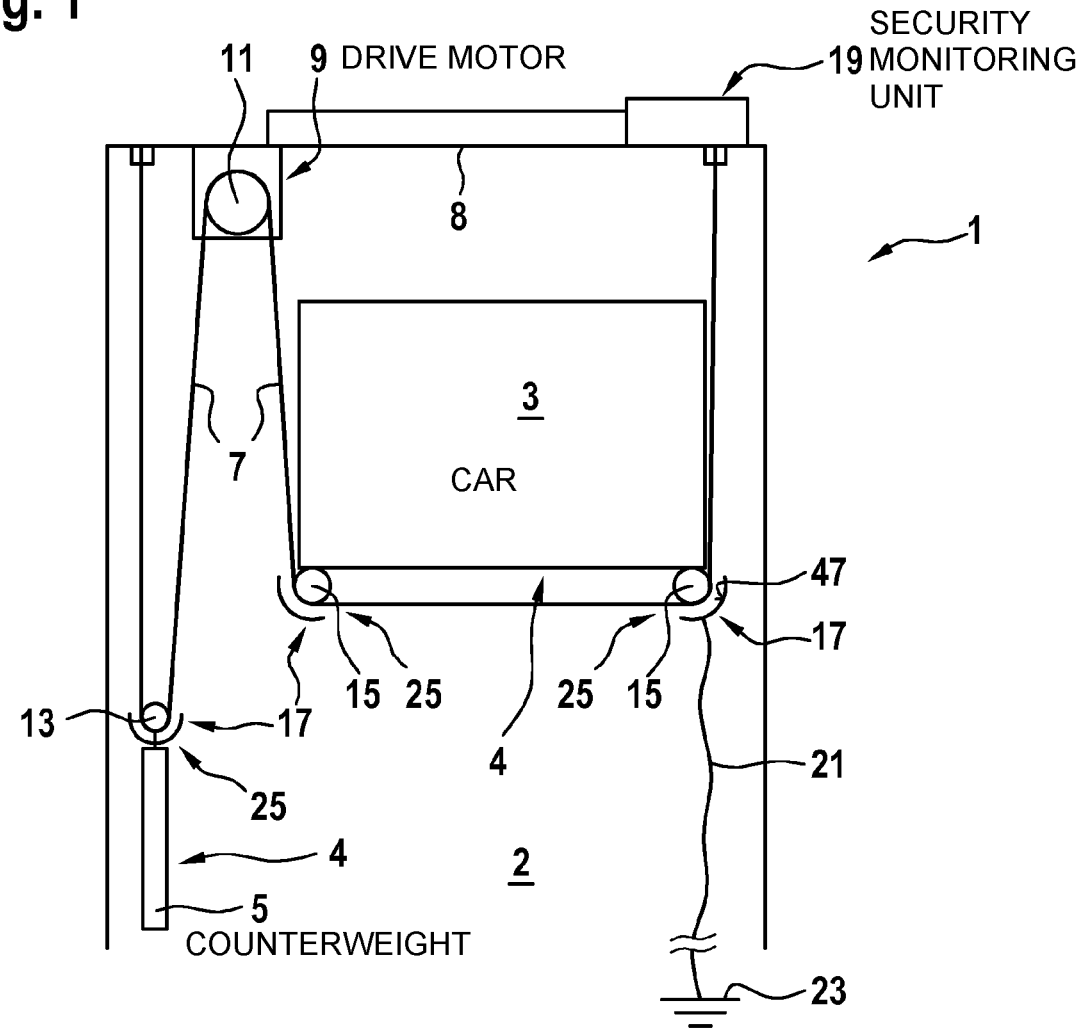
FIG. 1 shows components of an elevator installation according to the invention.

FIG. 1 shows components of an elevator installation according to the invention 1. An elevator car 3 and a counterweight 5 are provided in an elevator shaft 2 as movable elevator components 4. The elevator car 3 and the counterweight 5 are supported by a supporting means 7, also known as a support. The supporting means 7 may for example comprise a plurality of cables or belts. In the example shown, the supporting means 7 is fastened to a ceiling 8 of the elevator shaft 2 by its ends and passes around each of the deflecting rollers 13, 15, which are fastened to the counterweight 5 and the elevator car 3, respectively. In this way, the supporting means 7 can support both the elevator car 3 and the counterweight 5 counter to the gravitational force acting thereon. In addition, the supporting means 7 can be moved by means of a drive motor 9 by the supporting means 7 passing around a driving pulley 11 of said drive motor 9 and the driving pulley 11 being rotatingly driven.

A housing 17 is arranged at each of the deflecting rollers 13, 15 (only shown highly schematically in FIG. 1). The housing 17 surrounds both the relevant deflecting roller 13, 15 and the supporting means 7 diverted by the deflecting roller 13, 15 at least in part. In this case, the housing 17 is arranged and designed such that the supporting means 7 can also move along the relevant deflecting roller 13, 15, the relevant deflecting roller 13, 15 being mounted so as to be rotatable relative to the housing 17. In this case, the housing 17 is attached to the counterweight 5 or the elevator cab car 3 so as to be fixed in position. The housing 17 is provided inter alia to prevent the supporting means 7 from slipping off or coming off a lateral surface of the relevant deflecting roller 13, 15, in particular if tension on the supporting means 7 temporarily lessens in regions for example during emergency braking of said supporting means, resulting in a slack cable.

The elevator installation 1 also has a security monitoring unit 19. This security monitoring unit 19 is designed inter alia to monitor and in particular to detect a state of the supporting means 7 when damage to the supporting means 7 occurs. For this purpose, the security monitoring unit 19 is designed to apply an electrical voltage to electrically conductive wires provided in the supporting means 7 and to characterize properties of an electrical current flowing through these wires that then ensues. On the basis of the characterized properties of the electrical current, the security monitoring unit 19 can then draw conclusions on a current state of the supporting means and in particular the wires embedded therein.

In order for it to be possible to detect damage to a sheath surrounding the wires of the supporting means 7 in particular, the surface 47 of the housing 17 facing the supporting means is electrically conductive and is connected to a ground potential 23 by cables 21 (only shown once and highly schematically in FIG. 1), and is thus grounded.

If, for example, a wire embedded in the supporting means 7 protrudes outwards due to local damage to a sheath of the supporting means 7 and comes into contact with the electrically conductive surface 47 of the housing 17, a ground fault results that can be detected by the security monitoring unit 19 connected to the wires.

It should be noted that the housing 17 may also be designed in ways other than that shown in FIG. 1. In particular, it may be advantageous to arrange the housing 17 directly around the deflecting rollers 13, 15 as part of a deflecting roller arrangement 25; however, it is also possible to provide a corresponding housing 17 at a different point within the elevator installation 1 such that it surrounds the supporting means 7 at least in part. For example, a housing 17 could be provided on or close to the driving pulley 11 of the drive motor 9. In principle, a housing 17 could also be provided in a region in which it only locally surrounds the supporting means 7, but does not surround a deflecting roller 13, 15 or a driving pulley 11. It is also noted that a plurality of housings 17 are provided for a plurality of deflecting roller arrangements 25 in FIG. 2. It may however be sufficient to provide just one housing 17 of this type in an elevator installation 1.

Figure 2:
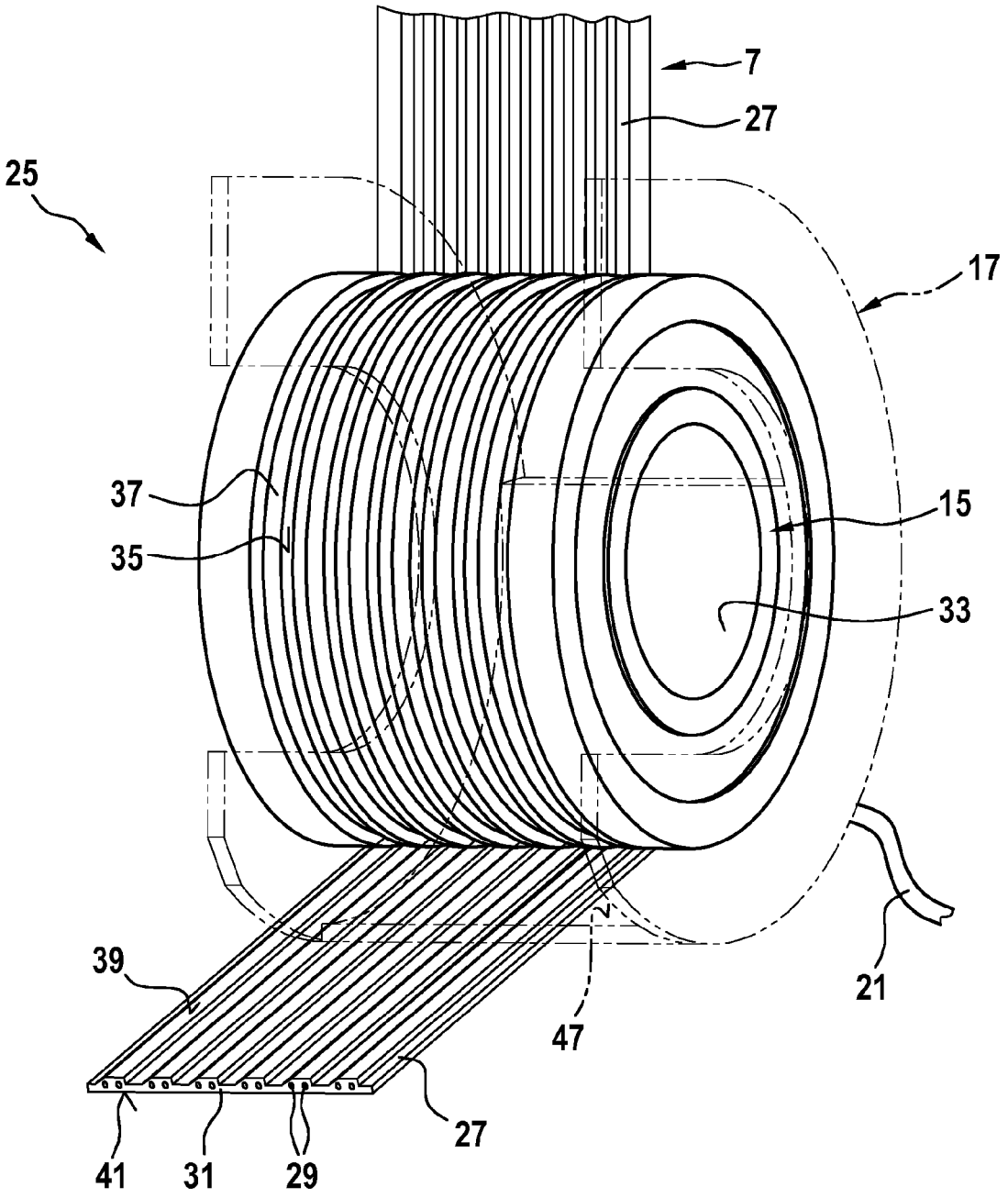
FIG. 2 is a perspective view of a deflecting roller arrangement according to the invention.

FIG. 2 is an enlarged perspective view of a deflecting roller arrangement 25 designed according to the invention.

Here, the deflecting roller 15 is provided as a cylindrical roller of which the lateral surface 35 is profiled with grooves 37 extending in the circumferential direction. The deflecting roller 15 comprises a cut-out 33 in the center, in which it can be rotatably supported by a bearing (not shown).

The supporting means or support 7 is shown as a belt 27 in the example shown. A plurality of wires 29 or wire meshes are provided in the belt 27 and bring about the actual load-bearing property of the supporting means 7. The wires 29 are embedded in a plastics covering 31. Here, a front surface 39 of the belt 27 forms a contact surface with the lateral surface 35 of the deflecting roller 15 and is accordingly profiled to be complementary thereto. A rear surface 41 of the belt that is opposite said front surface 39 is substantially smooth.

The housing 17 forms a part of the deflecting roller arrangement 25 that surrounds the deflecting roller 15 at least in part. In this case, the housing 17 is substantially semicylindrical, i.e. has a substantially approximately U-shaped cross section. In this case, the housing 17 is dimensioned and arranged such that at least parts of the deflecting roller 15 are accommodated in the inner region thereof. In addition, the housing 17 is designed such that the supporting means 7 can be moved toward the deflecting roller 15 and then away from said roller again in an unimpeded manner.

The housing 17 comprises at least one region that is electrically conductive on its inner surface 47 facing the supporting means 7 or the lateral surface 35 of the deflecting roller 15. A cable 21 is electrically connected to this region such that this region can be grounded by the cable 21.

Figure 3:
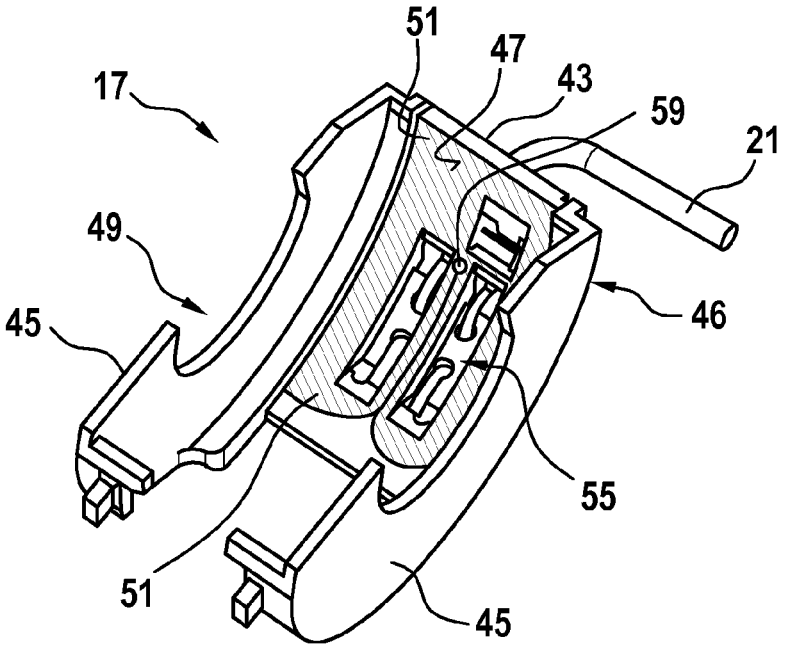
FIG. 3 is a perspective view of a housing for a deflecting roller arrangement according to the invention.
Figure 4:
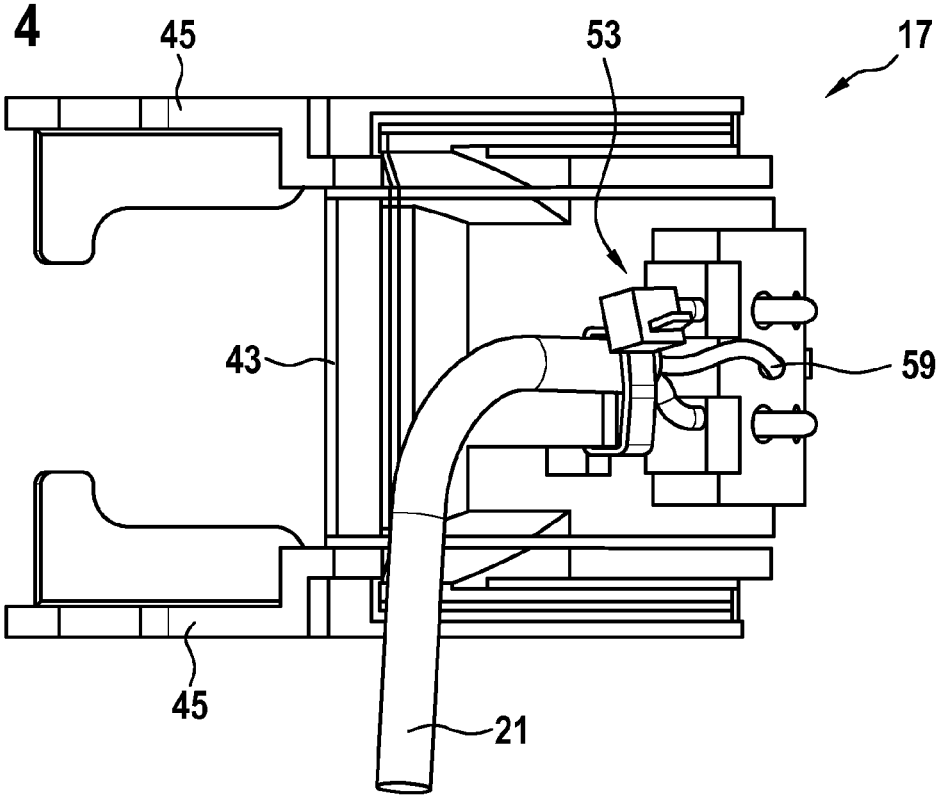
FIG. 4 is a first plan view of the housing from FIG. 3.
Figure 5:
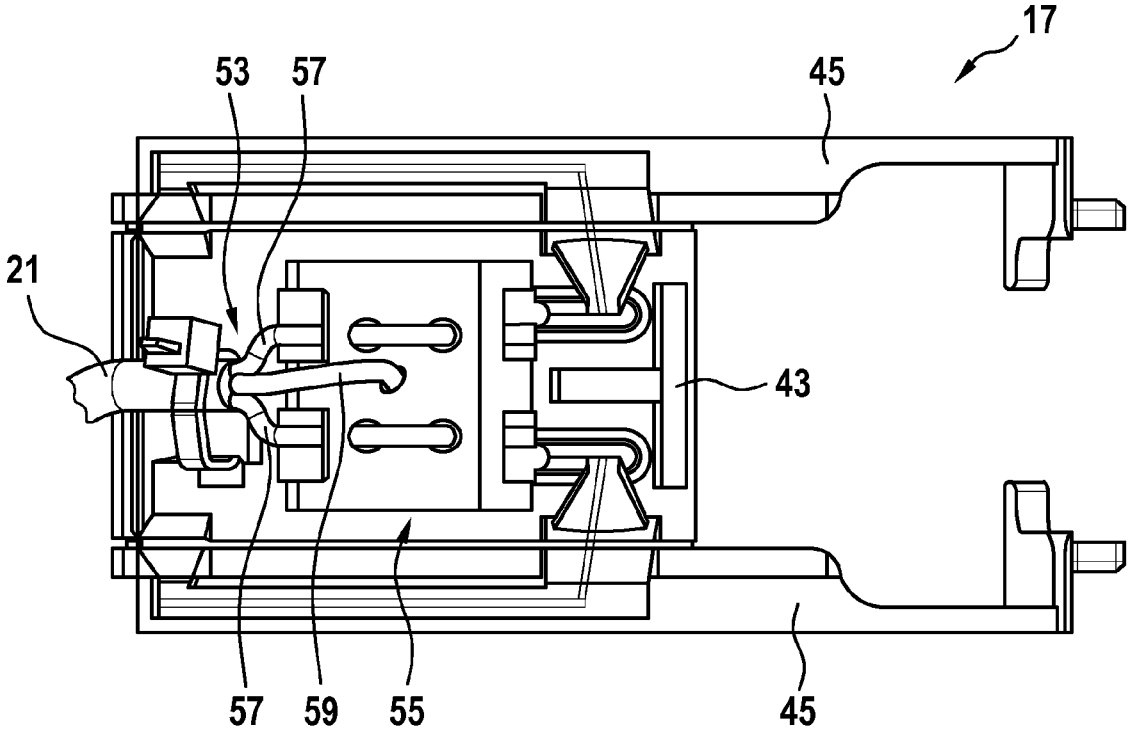
FIG. 5 is a second alternative plan view of the housing from FIG. 3.

FIGS. 3, 4 and 5 are perspective views and two different plan views of an example of a housing 17 for a deflecting roller arrangement 25.

The housing 17 substantially consists of a partially cylindrical part 43 forming a lateral surface of the housing 17 and two parts 45 which are adjacent to axial flanks of this part 43 and form end faces, and in which a semicircular cut-out 49 is made in the center. The part 43 forming the lateral surface of the housing 17 and the parts 45 forming the end faces can together form a housing body 46, which may for example be made of plastics material. In the deflecting roller arrangement 25, the parts 45 forming the end faces may each be arranged so as to be adjacent to end faces of the deflecting roller 15 in the axial direction. The part 43 of the housing 17 forming the intermediate lateral surface may be arranged so as to be adjacent to the lateral surface 35 of the deflecting roller 15.

A surface 47 facing the lateral surface 35 of the deflecting roller 15 on the part 43 of the housing 17 forming the lateral surface is provided with an electrically conductive layer 51 in the example shown. In the example shown, this layer 51 covers a large part of the surface 47 facing the interior of the housing 17. The electrically conductive layer 51 may for example be a metal layer or metalized plastics layer glued to the surface 47 of the part 43 facing inward.

The electrically conductive layer 51 is constructed such that, upon mechanical contact with an electrically conductive object making contact from the interior of the housing 17, it also enters into electrical contact with said object. In other words, the layer 51 is intended to be electrically conductive on its surface facing inward and not to be covered with an electrically non-conductive layer, for example.

Alternatively, the electrically conductive layer 51 may also be applied, i.e. vapor-deposited or printed, directly onto the surface 47 of the housing 17 facing inward.

As another alternative, just a small-area and preferably elongate electrically conductive conductor path may also be provided on the surface 47 of the housing 17 facing inward, instead of an extensive layer 51.

The electrically conductive layer 51 is connected to a connector 53 by a cable 21 and can thus be grounded thereby.

In the example shown in FIGS. 3 to 5, the housing 17 also has a breakage detection apparatus 55. This breakage detection apparatus 55 is used to detect any possible breakage in the housing 17, for example by one or more distributed conductor paths (not visible in the drawings) being provided on the housing 17 of which any mechanical breakage can be detected on the basis of an associated electrical interruption. For this purpose, the breakage detection apparatus 55 has an electrical circuit in which the conductor path(s) is/are likewise connected to conductors provided in the cable 21 by means of electrical connections 57. These conductors are however kept separate from a grounding conductor 59 connecting to the electrical ground potential 23; i.e. the conductor 59 bringing about the grounding and the conductors connected to the breakage detection apparatus 55 are received in the same cable 21, but are not electrically interconnected.

In summary, a possible embodiment of the invention may be defined as follows: The invention relates to an elevator installation 1 in which damage to a supporting means 7, in particular damage to a sheath of the supporting means 7, can be advantageously detected. On the elevator installation 1, a housing 17 surrounding the supporting means 7 at least in part is provided, for example at a deflecting roller arrangement 25. A surface 47 of the housing 17 facing the supporting means 7 is electrically conductive and is electrically grounded. If the supporting means 7 or a wire coming out of a damaged supporting means comes in contact with the housing 17, an electrical ground fault results. Said ground fault can be detected by means of a security monitoring unit 19 by monitoring a current flowing through wires of the supporting means, and the damage to the supporting means 7 can thus be inferred.

Finally, it should be noted that terms such as "comprising" and the like do not exclude other elements or steps, and terms such as "a", "an" or "one" do not exclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 Elevator installation
2 Elevator shaft
3 Elevator car
4 Movable elevator component
5 Counterweight
7 Supporting means
8 Elevator shaft ceiling
9 Drive motor
11 Driving pulley
13 Deflecting roller at counterweight
15 Deflecting roller at elevator car
17 Housing
19 Security monitoring unit
21 Cable for grounding
23 Ground potential
25 Deflecting roller arrangement
27 Belt
29 Wires

31 Sheath
33 Central cut-out
35 Lateral surface
37 Grooves on the deflecting roller
39 Front surface of the supporting means
41 Rear surface of the supporting means
43 Part of housing forming lateral surface
45 Part of housing forming end faces
46 Housing body
47 Surface of the housing facing inward
49 Central cut-out in the housing
51 Electrically conductive layer
53 Connector
55 Breakage detection apparatus
57 Electrical connections
59 Grounding conductor

The invention claimed is:

1. An elevator installation, comprising:
a supporting means;
a movable elevator component supported by the supporting means;
a housing attached to the movable elevator component and surrounding at least a part of the supporting means;
wherein the supporting means can move relative to the housing; and
wherein the housing includes a housing body formed of a non-conductive plastics material and an electrically conductive element which is electrically grounded and is arranged on a surface of the housing body facing the supporting means.

2. The elevator installation according to claim 1 including a deflecting roller fastened to the movable elevator component, wherein the supporting means supports the movable elevator component by passing around the deflecting roller at least in part, wherein the housing surrounds the deflecting roller at least in part in a region in which the supporting means passes around the deflecting roller, and the housing is spaced from the supporting means in the region.

3. The elevator installation according to claim 1 wherein the surface of the housing body facing the supporting means is opposite a rear surface of the supporting means, wherein the rear surface of the supporting means is opposite a front surface of the supporting means contacting a deflecting roller or a driving pulley.

4. The elevator installation according to claim 1 wherein the electrically conductive element is an electrically conductive layer arranged on the surface of the housing body facing the supporting means.

5. The elevator installation according to claim 4 wherein the electrically conductive layer is formed by an electrically conductive foil.

6. The elevator installation according to claim 1 wherein the electrically conductive element is an electrically conductive conductor path arranged on the surface of the housing body facing the supporting means.

7. The elevator installation according to claim 1 wherein the electrically conductive element is grounded by a cable attached to the housing.

8. The elevator installation according to claim 1 wherein the supporting means includes at least one electrically conductive wire and wherein the elevator installation includes a security monitoring unit that applies an electrical voltage to the at least one wire and is adapted to detect changes in properties of an electrical current conducted through the at least one wire.

9. The elevator installation according to claim 8 wherein the changes in properties of an electrical current conducted through the at least one wire include an electrical ground fault of the at least one wire.

10. The elevator installation according to claim 1 wherein the housing is fastened to the movable elevator component.

11. A deflecting roller arrangement for an elevator installation, comprising:
a deflecting roller;
a housing, wherein the deflecting roller is adapted to be mounted in the elevator installation to rotate relative to the housing, wherein the housing surrounds the deflecting roller in a region being adjacent to a surface of the deflecting roller; and
wherein the housing includes a housing body formed of a non-conductive plastics material and an electrically conductive element arranged on a surface of the housing body facing the deflecting roller, where the electrically conductive element is connected to an electrical connector adapted to connect to an electrical ground potential.

12. The deflecting roller arrangement according to claim 11 wherein the surface of the housing body facing the deflecting roller is opposite a lateral surface of the deflecting roller.

13. The deflecting roller arrangement according to claim 11 wherein the electrically conductive element is an electrically conductive layer arranged on the surface of the housing body facing the deflecting roller.

14. The deflecting roller arrangement according to claim 13 wherein the electrically conductive layer is formed of an electrically conductive foil.

15. The deflecting roller arrangement according to claim 11 wherein the electrically conductive element is an electrically conductive conductor path arranged on the surface of the housing body facing the deflecting roller.

16. The deflecting roller arrangement according to claim 11 including a cable connected to the electrical connector for electrical connection to the electrical ground potential.

17. The deflecting roller arrangement according to claim 11 including a breakage detection apparatus having at least one electrically conductive conductor path extending along the housing.

18. An elevator installation, comprising:
a supporting means;
a movable elevator component supported by the supporting means;
a housing surrounding at least a part of the supporting means, wherein the supporting means can move relative to the housing, and wherein the housing includes a housing body formed of a non-conductive plastics material and an electrically conductive element arranged on a surface of the housing body facing the supporting means;
a deflecting roller, wherein the supporting means supports the movable elevator component by passing around the deflecting roller at least in part, wherein the housing surrounds the deflecting roller at least in part in a region in which the supporting means passes around the deflecting roller, and wherein the housing is spaced from the supporting means in the region;
wherein the surface of the housing body facing the supporting means is opposite a rear surface of the supporting means, wherein the rear surface of the supporting means is opposite a front surface of the supporting means that contacts the deflecting roller in the region;

wherein the electrically conductive element is electrically grounded by a cable attached to the element; and wherein the supporting means includes at least one sheathed, electrically conductive wire, and wherein the elevator installation includes a security monitoring unit that applies an electrical voltage to the at least one wire and detects changes in properties of an electrical current conducted through the at least one wire.

19. The elevator installation according to claim 18 wherein the properties include an electrical ground fault of the at least one wire.

* * * * *